US008336980B2

(12) United States Patent
Sanada

(10) Patent No.: US 8,336,980 B2
(45) Date of Patent: Dec. 25, 2012

(54) IMAGE RECORDING APPARATUS AND IMAGE RECORDING METHOD

(75) Inventor: Kazuo Sanada, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 554 days.

(21) Appl. No.: 12/569,707

(22) Filed: Sep. 29, 2009

(65) Prior Publication Data

US 2010/0079526 A1 Apr. 1, 2010

(30) Foreign Application Priority Data

Sep. 30, 2008 (JP) ..... 2008-254807

(51) Int. Cl.
*B41J 29/38* (2006.01)

(52) U.S. Cl. ..... 347/14

(58) Field of Classification Search ..... 347/14
See application file for complete search history.

(56) References Cited

U.S. PATENT DOCUMENTS 6,769,759 B2 * 8/2004 Yamasaki et al. ..... 347/41
2003/0048326 A1 3/2003 Yamasaki et al.

FOREIGN PATENT DOCUMENTS

JP 6-226982 A 8/1994
JP 7-314737 A 12/1995
JP 7-314784 A 12/1995
JP 2003-11344 A 1/2003
JP 2003-34022 A 2/2003
JP 2004-66725 A 3/2004
JP 2004-174750 A 6/2004
JP 2004-188763 A 7/2004
JP 2004-202962 A 7/2004
JP 2006-27131 A 2/2006

OTHER PUBLICATIONS

Japanese Office Action issued in related JP Application No. 2008-254807 on Sep. 13, 2012.

* cited by examiner

*Primary Examiner* — Uyen Chau N Le
*Assistant Examiner* — Hoang Tran
(74) *Attorney, Agent, or Firm* — Birch, Stewart, Kolasch & Birch, LLP

(57) ABSTRACT

The image recording apparatus includes: a recording head which has at least one row of recording elements arranged at a prescribed arrangement interval in a sub-scanning direction; a scanning device which moves the recording head in a main scanning direction so as to perform recording of a same main scanning line by means of a plurality of scans in the main scanning direction with respect to a recording medium; a conveyance device which conveys the recording head and the recording medium relatively to each other in the sub-scanning direction; a recording control device which controls the recording head to perform recording by using at least two of the recording elements in the recording of the same main scanning line; a recording element selection device which selects a combination of the recording elements to perform recording of the same main scanning line in accordance with a status of each of the recording elements; and a conveyance control device which determines a combination of feed amounts in the sub-scanning direction corresponding to the combination of the recording elements selected by the recording element selection device and controls the conveyance device in accordance with the determined combination of feed amounts in the sub-scanning direction.

16 Claims, 12 Drawing Sheets

IMAGE RECORDING APPARATUS AND IMAGE RECORDING METHOD

BACKGROUND OF THE INVENTION

1. Field of the Invention

The present invention relates to an image recording apparatus and an image recording method, and more particularly to image recording technology using a serial scanning method which carries out image recording on a recording medium by scanning the recording medium with a recording head in a main scanning direction while intermittently conveying the recording medium in a sub-scanning direction.

2. Description of the Related Art

An inkjet recording apparatus is suitable for use as a general output apparatus for images and texts, and the like. In image recording using an inkjet recording apparatus, ink is ejected from a plurality of nozzles arranged in an inkjet recording head in accordance with image data, thereby forming a desired image on a recording medium.

An inkjet recording apparatus employs a composition using a serial scanning method which records an image by alternately repeating image recording in the main scanning direction and intermittent conveyance of the recording medium in the sub-scanning direction. Image recording based on a serial scanning method employs technology for suppressing the occurrence of periodic density non-uniformities caused by variations in nozzle ejection characteristics (the ink ejection direction) by using technology such as an "interlacing method" which carries out recording by performing a plurality of main scanning operations between the nozzle positions and a "multi-scan method" which carries out image recording by a plurality of main scanning operations in respect of a region where image recording is possible in one main scanning operation.

If an inkjet head is left unused for a long period of time, the ink inside the nozzles solidifies and there is a high possibility of the occurrence of blockages. In a state such as this, it becomes impossible to eject ink from the nozzles and this has a significant effect on the quality of the recorded image. If an ejection abnormality of this kind occurs, restoration processing is carried out in order to remove the ink blocked inside the nozzles and restore the nozzles to a normal state. On the other hand, there may exist nozzles which are not restored even if restoration processing is carried out, and various methods for responding to cases of this kind have been proposed.

For example, a method has been proposed whereby a nozzle suffering ejection failure is identified using a test pattern, and the volume and ejection direction of the ink droplets ejected from other nozzles adjacent to the ejection failure nozzle are changed so as to complement the dot that should originally have been formed by the ejection failure nozzle, by means of the adjacent nozzles.

Japanese Patent Application Publication No. 07-314737 discloses a printing apparatus which judges and stores ejection failure nozzles in a recording head, does not perform printing from ejection failure nozzles, and performs printing with a group of nozzle blocks that has the longest length in the nozzles capable of printing.

Japanese Patent Application Publication No. 07-314784 discloses a printer which indicates the fact that, of a plurality of dot printing devices (nozzles), the printing function of one or a plurality of dot printing devices has become unsatisfactory, and controls the line width in the sub-scanning direction so as to perform printing free of dot omissions by means of other dot printing devices, excluding the indicated dot printing devices.

Furthermore, the nozzles provided in the inkjet head have variation in their intrinsic ejection characteristics as a result of processing variations during manufacture. For example, variations in the ejection direction, the dot forming position and the ejection volume occurs due to variation in the orientation of the nozzle openings, variation in their forming positions and variation in their size. Band-shaped non-uniformities can occur as a result of this kind of variation in the intrinsic ejection characteristics of the nozzles, giving rise to significant deterioration in image quality. More specifically, there may be situations where the relationship between nozzles is poor, for instance, where adjacent nozzles have mutually opposite variations in the ejection direction. Situations such as these are handled by employing a method which performs complementing using peripheral nozzles or a method which performs complementing in another scanning action of a multi-pass method.

Japanese Patent Application Publication No. 2003-011344 discloses, as a method for correcting the amount of feed in the sub-scanning direction so as to prevent the occurrence of band-shaped non-uniformities by using a test pattern, a method for correcting paper feed errors in a printer that performs recording in an interlaced recording mode by investigating the print results of a test pattern to determine respective correction values for the paper feed amount and performing image recording in an interlaced recording mode in accordance with these correction values.

However, in a method which performs droplet ejection assigned to an ejection failure nozzle by means of other nozzles, through altering the volume and ejection direction of ink droplets ejected from the nozzles peripheral to the ejection failure nozzle, there may be cases where it is not possible to perform correction due to the ejection status of the nozzles that are to perform corrective droplet ejection, for instance, if a nozzle that is to perform corrective droplet ejection has suffered an ejection abnormality, or the like.

Furthermore, in the methods described in Japanese Patent Application Publication Nos. 07-314737 and 07-314784, since a large number of nozzles peripheral to a nozzle suffering ejection failure are not used, then the print rate (productivity) declines. Moreover, in the method described in Japanese Patent Application Publication No. 2003-011344, if the variation in the ejection characteristics reaches a certain magnitude, then there may be cases where it is not possible to obtain sufficient beneficial effects by correcting the paper feed amount.

The image recording method described in Japanese Patent Application Publication No. 2003-011344 focuses on paper feed error and does not control the paper feed amount in accordance with ejection abnormalities in the nozzles or variation in the ejection characteristics, and therefore it is difficult to prevent decline in the image quality caused by ejection abnormalities in the nozzles or variation in the ejection characteristics by means of this image recording method.

SUMMARY OF THE INVENTION

The present invention has been contrived in view of the aforementioned circumstances, an object thereof being to provide an image recording apparatus and an image recording method whereby desirable image recording is achieved by preventing decline in image quality due to the occurrence of abnormalities in recording elements or variation in the intrinsic characteristics of the recording elements.

In order to attain the aforementioned object, the present invention is directed to an image recording apparatus, comprising: a recording head which has at least one row of recording elements arranged at a prescribed arrangement interval in a sub-scanning direction; a scanning device which moves the recording head in a main scanning direction so as to perform recording of a same main scanning line by means of a plurality of scans in the main scanning direction with respect to a recording medium; a conveyance device which conveys the recording head and the recording medium relatively to each other in the sub-scanning direction; a recording control device which controls the recording head to perform recording by using at least two of the recording elements in the recording of the same main scanning line; a recording element selection device which selects a combination of the recording elements to perform recording of the same main scanning line in accordance with a status of each of the recording elements; and a conveyance control device which determines a combination of feed amounts in the sub-scanning direction corresponding to the combination of the recording elements selected by the recording element selection device and controls the conveyance device in accordance with the determined combination of feed amounts in the sub-scanning direction.

According to the present invention, in image recording based on a multi-pass method which performs recording of the same main scanning line by means of a plurality of scans, since a combination of nozzles to perform recording of the same main scanning line is selected in accordance with the status of the recording elements and since the feed in the sub-scanning direction is controlled in accordance with the selected combination of nozzles, then the defect rate of the recording head is reduced and decline in the quality of the recorded image is prevented.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of Inkjet Recording Apparatus

Figure 1:
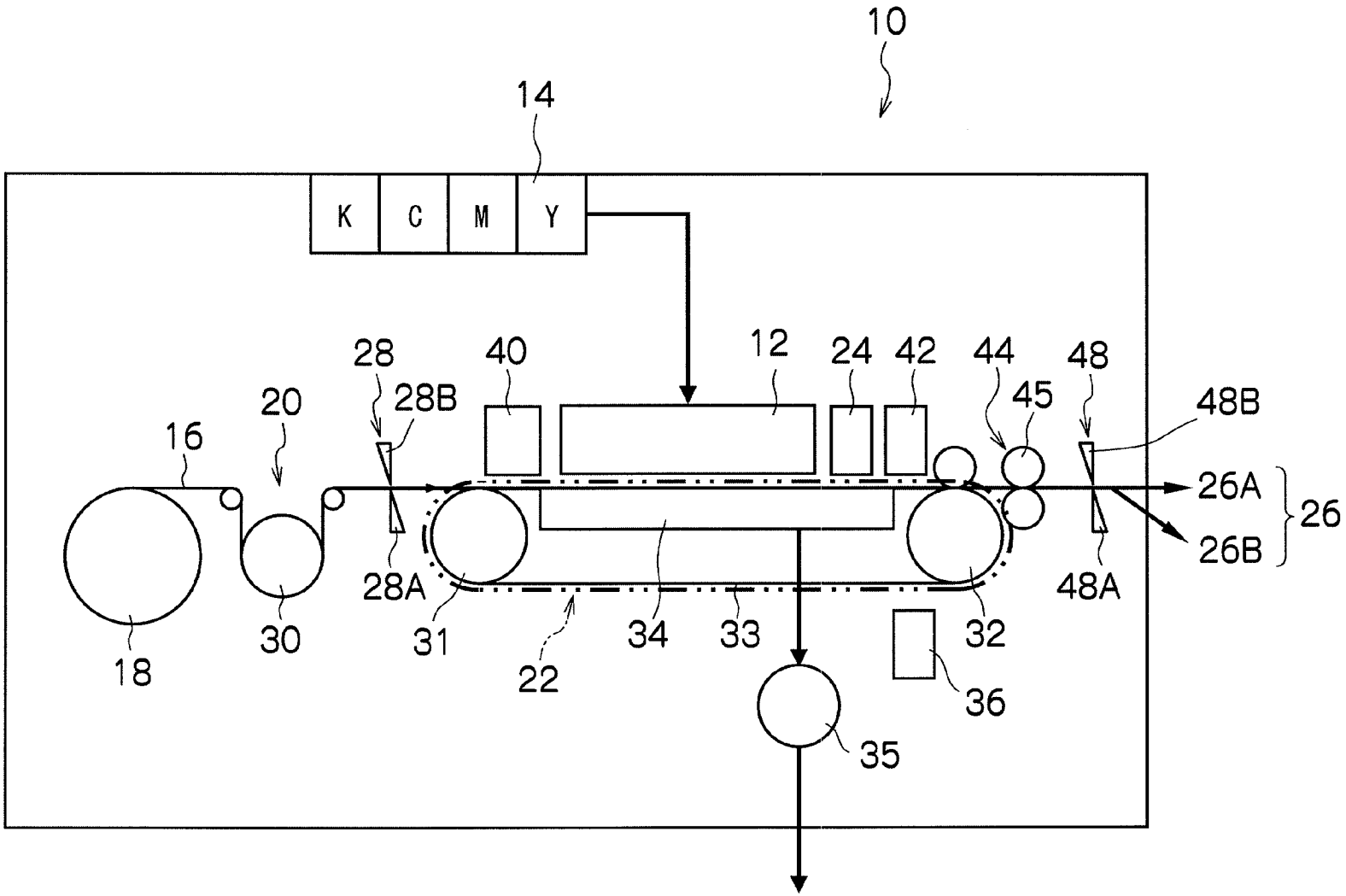
FIG. 1 is a general schematic drawing of an inkjet recording apparatus according to an embodiment of the present invention.

FIG. 1 is a schematic diagram showing a general configuration of an inkjet recording apparatus 10 according to an embodiment of the present invention.

As shown in FIG. 1, the inkjet recording apparatus 10 includes: a print unit 12 having a plurality of inkjet heads 12K, 12C, 12M, and 12Y (not shown in FIG. 1, but shown in FIG. 2) provided for ink colors of black (K), cyan (C), magenta (M), and yellow (Y), respectively; an ink storing and loading unit 14 for storing inks of K, C, M and Y to be supplied to the inkjet heads; a paper supply unit 18 for supplying recording paper 16; a decurling unit 20 removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

In the case of a composition where recording papers of a plurality of types can be used, desirably, an information recording body, such as a bar code or a wireless tag, which records information about the paper type is attached to the magazine, and the type of paper used is identified automatically by reading in the information on this information recording body by means of a prescribed reading apparatus, the ejection of ink being controlled so as to achieve suitable ink ejection in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite to the curl direction in the magazine. In this, the heating temperature is preferably controlled in such a manner that the medium has a curl in which the surface on which the print is to be made is slightly rounded in the outward direction.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 forms a flat plane.

The belt 33 has a width that is greater than the width of the recording paper 16, and a plurality of suction apertures (not shown) are formed on the belt surface. A suction chamber 34 is disposed in a position facing the nozzle surface of the print unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor 88 (not shown in FIG. 1, but shown in FIG. 6) being transmitted to at least one of the rollers 31 and 32, which the belt 33 is set around, and the recording paper 16 held on the belt 33 is conveyed in the paper conveyance direction (sub-scanning direction; direction to the right in FIG. 1).

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can have a roller nip conveyance mechanism, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The ink storing and loading unit 14 has tanks (main tanks) which store inks of colors corresponding to the respective heads of the print unit 12. Moreover, the ink storing and loading unit 14 also has a notifying device (display device, alarm generating device, or the like) for generating a notification if the remaining amount of ink has become low, as well as having a mechanism for preventing incorrect loading of ink of the wrong color.

The print determination unit 24 has an image sensor (line sensor or the like) for capturing an image of the ink-droplet deposition result of the print unit 12, and functions as a device to check for ejection defects such as clogs of the nozzles or the variation in the droplet ejection speed (ejection characteristics) of the nozzles based on the ink-droplet deposition images read by the image sensor.

The print determination unit 24 of the present embodiment is configured with a line sensor having rows of photoelectric transducing elements with a width that is greater than the image recording width of the recording paper 16. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 determines the ejection from the respective heads by reading in a test pattern which has been printed by the heads of the respective colors. The ejection determination includes the presence of ejection, measurement of the dot size, and measurement of the dot landing position. Furthermore, the variation in the droplet ejection speed of the nozzles is also judged on the basis of the results read by the print determination unit 24.

A heating fan 40 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown, the paper output unit 26A for the target prints is provided with a sorter for collecting prints according to print orders.

Although a configuration with four standard colors, K, M, C and Y, is described in the present embodiment, the combinations of the ink colors and the number of colors are not limited to these, and light and/or dark inks can be added as required. For example, it is possible to adopt a composition which additionally comprises heads for ejecting light inks, such as light cyan, light magenta, and the like.

Figure 2:
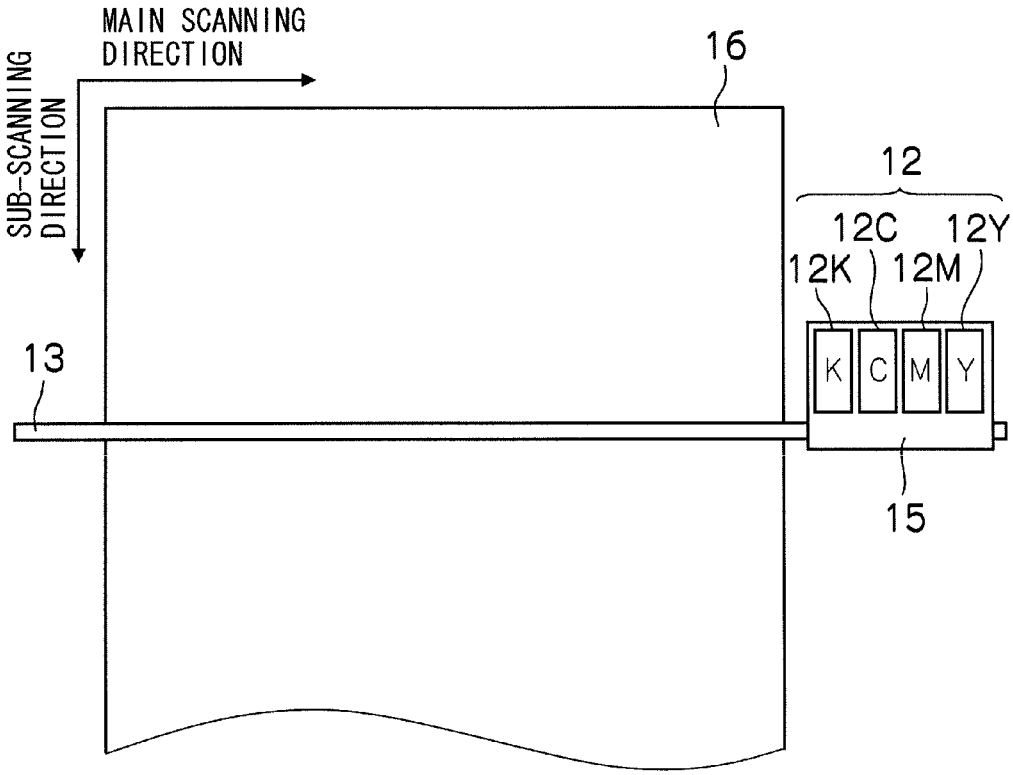
FIG. 2 is a general schematic drawing showing the composition of the periphery of the print unit of the inkjet recording apparatus shown in FIG. 1.

FIG. 2 is a general schematic drawing showing the composition of the periphery of the print unit 12 in the inkjet recording apparatus 10. The inkjet recording apparatus 10 has a carriage 15, which is able to move reciprocally in the breadthways direction of the recording paper 16 (main scanning direction) while being guided on a guide rail 13. The inkjet heads 12K, 12C, 12M and 12Y corresponding respectively to the inks of the colors black (K), cyan (C), magenta (M) and yellow (Y) are mounted on the carriage 15.

The inkjet recording apparatus 10 described in the present embodiment employs a serial scanning method in which image recording is performed in the main scanning direction by ejecting ink droplets of corresponding colored inks respectively from the nozzles of the heads 12K, 12C, 12M and 12Y while scanning the recording medium by moving the carriage 15 on which the heads 12K, 12C, 12M and 12Y are mounted in the main scanning direction, conveying the recording paper 16 by a prescribed amount in the sub-scanning direction after performing one image recording action in the main scanning direction, and then performing a subsequent image recording action in the main scanning direction, these operations being repeated so as to recording a desired image on the recording paper 16.

Furthermore, a multi-scan method which records one main scanning line by means of a plurality of main scanning actions and an interlace method which records between the nozzle positions in the sub-scanning direction by means of a plurality of main scanning actions are also employed.

Structure of Head

Next, the structure of the heads 12K, 12C, 12M and 12Y will be described. The heads 12K, 12C, 12M and 12Y of the respective ink colors have the same structure, and a reference numeral 50 is hereinafter designated to any of the heads.

Figure 3:
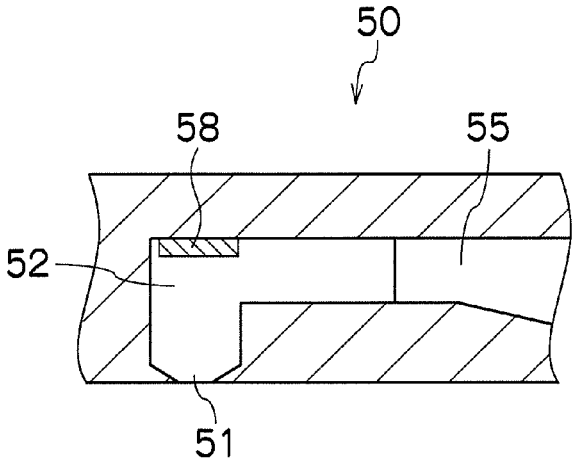
FIG. 3 is a cross-sectional diagram showing the structure of the head shown in FIG. 2.

FIG. 3 is a cross-sectional diagram showing the three-dimensional structure of a head 50. As shown in FIG. 3, each head 50 includes a plurality of nozzles 51 which eject ink, pressure chambers (liquid chambers) 52 provided so as to correspond respectively to each of the plurality of nozzles 51, and a common flow channel 55 connected to the respective pressure chambers 52 which distributes and supplies ink to the respective pressure chambers 52. Furthermore, a heater 58 is provided as a heating element inside each pressure chamber 52, and an ink droplet is ejected from the nozzle 51 by utilizing the heat energy generated by the heater 58.

Instead of a thermal method which employs the heat energy of the heater 58 as shown in FIG. 3, it is also possible to employ a piezo jet method which applies mechanical energy due to the deformation of a piezoelectric element to the ink inside the pressure chamber 52.

Figure 4:
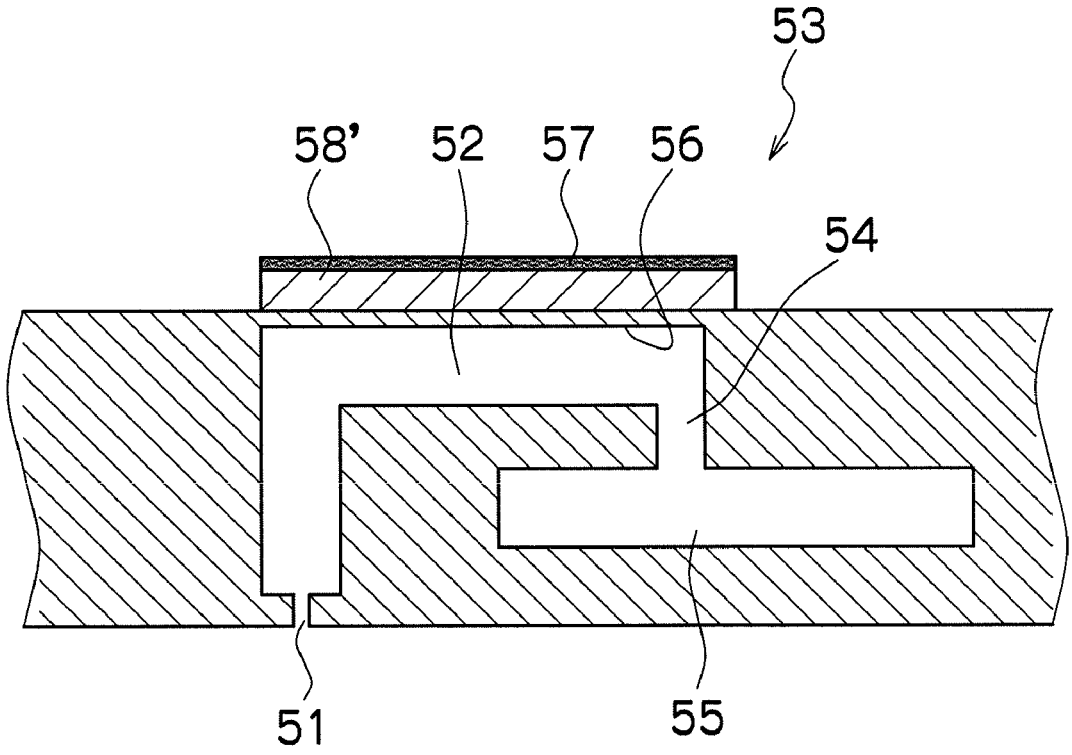
FIG. 4 is a cross-sectional diagram of a further mode of the head shown in FIG. 2.

FIG. 4 is a cross-sectional diagram of a head 50 which employs a piezo jet method. In FIG. 4, parts which are the same as or similar to FIG. 3 are denoted with the same reference numerals and further explanation thereof is omitted here.

As shown in FIG. 4, the head 50 includes a plurality of ink chamber units 53. Each of the ink chamber units 53 has a nozzle 51 which is an ink droplet ejection hole, a pressure chamber 52 corresponding to the nozzle 51, and the like. Each pressure chamber 52 provided corresponding to the nozzle 51 has a substantially square planar shape (not illustrated), and the nozzle 51 and a supply port 54 are arranged in opposing corners on a diagonal of this planar shape. The pressure chambers 52 are connected to a common channel 55 through the supply ports 54. The common channel 55 is connected to an ink supplying tank (not shown), which is a base tank that supplies ink, and the ink supplied from the ink supplying tank is delivered through the common flow channel 55 to the pressure chambers 52.

A piezoelectric element 58' provided with an individual electrode 57 is bonded to a diaphragm 56 which forms the upper face of the pressure chamber 52 and also serves as a common electrode, and the piezoelectric element 58' is deformed when a drive signal is supplied to the individual electrode 57, thereby causing ink to be ejected from the nozzle 51. When ink is ejected, new ink is supplied to the pressure chamber 52 from the common flow passage 55, via the supply port 54.

Each head 50 is also integrated with a respective sub tank, and ink stored in the sub tank is supplied progressively in accordance with consumption of ink by the head, during a recording operation. Furthermore, if the remaining amount of ink inside the sub tank reaches a prescribed amount or lower as the recording operation progresses, then the carriage 15 is moved to a prescribed standby position as shown in FIG. 2 (maintenance position). In the standby position, ink is supplied to the sub tank from the main tank and when the sub tank has become filled with ink, the recording operation is restarted. The main tank is equivalent to the ink storing and loading unit 14 shown in FIG. 1. Furthermore, it is also possible to employ a cartridge system in which a replaceable ink cartridge can be mounted on the carriage 15 and the ink cartridge is replaced as and when the ink inside the cartridge has run out.

Description of Nozzle Arrangement

Figure 5:
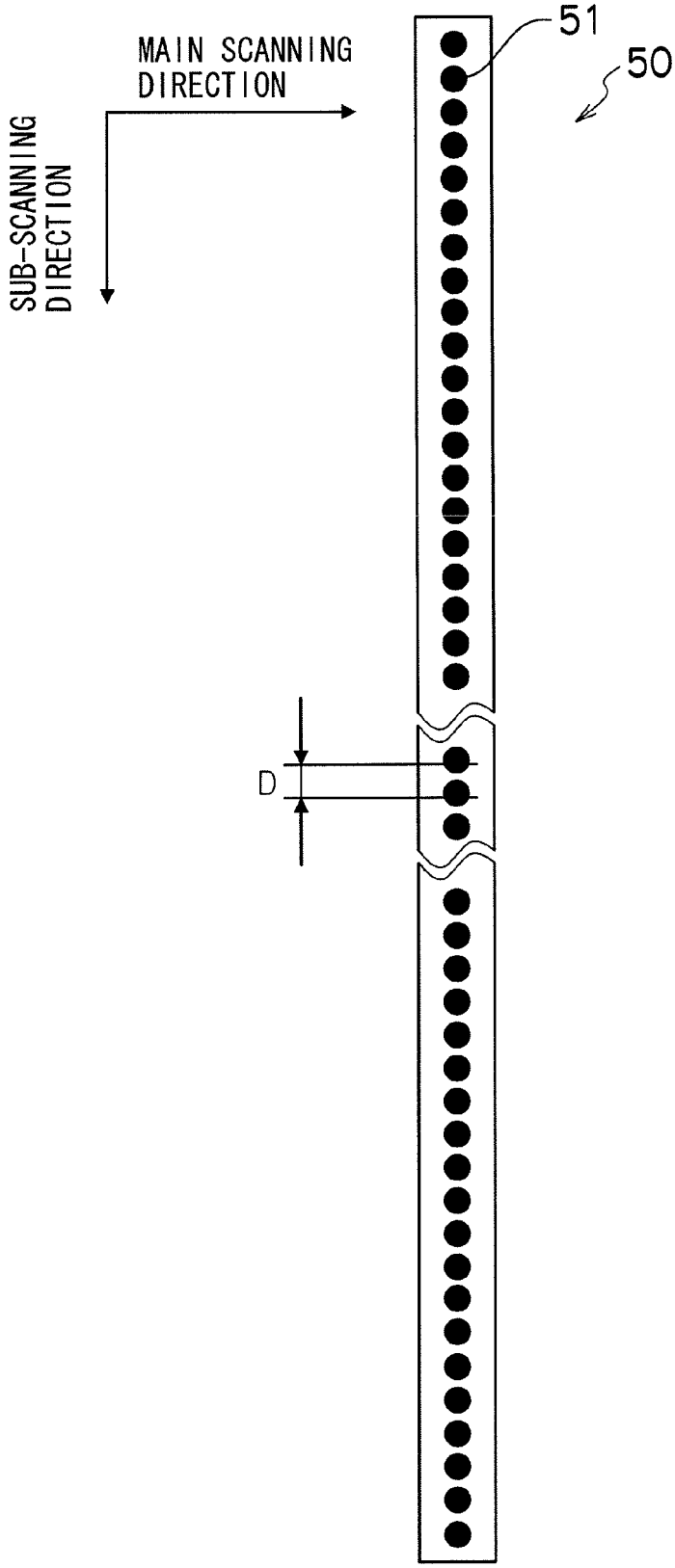
FIG. 5 is a plan diagram showing an example of the arrangement of nozzles in the head shown in FIG. 2.

Next, the arrangement of nozzles in the head 50 employed in the present embodiment will be described. FIG. 5 is an approximate plan diagram showing the nozzle arrangement in the head 50.

The head 50 shown in FIG. 5 has a structure in which a plurality of nozzles 51 are aligned in one row in the sub-scanning direction. In image recording using the head 50 shown in FIG. 5, an interlace method is employed and the recording density in the sub-scanning direction is k (where k is an integer greater than 1) times the nozzle density D. For example, if the nozzle density D is 600 (dpi), then the recording density in the sub-scanning direction when k=2 will be 1200 (dpi). Furthermore, a multi-path method which performs recording by means of s (where s is an integer greater than 1) main scanning actions in respect of the same main scanning line is also employed.

FIG. 5 shows an example of the nozzle arrangement having the single nozzle row in which the plurality of nozzles are aligned in the sub-scanning direction, but it is also possible to have a plurality of nozzle rows. For example, it is also possible to employ a staggered arrangement in which two nozzle rows are arranged in staggered fashion, or a matrix arrangement in which the nozzles are arranged in a two-dimensional configuration, or the like.

Description of Control System

Figure 6:
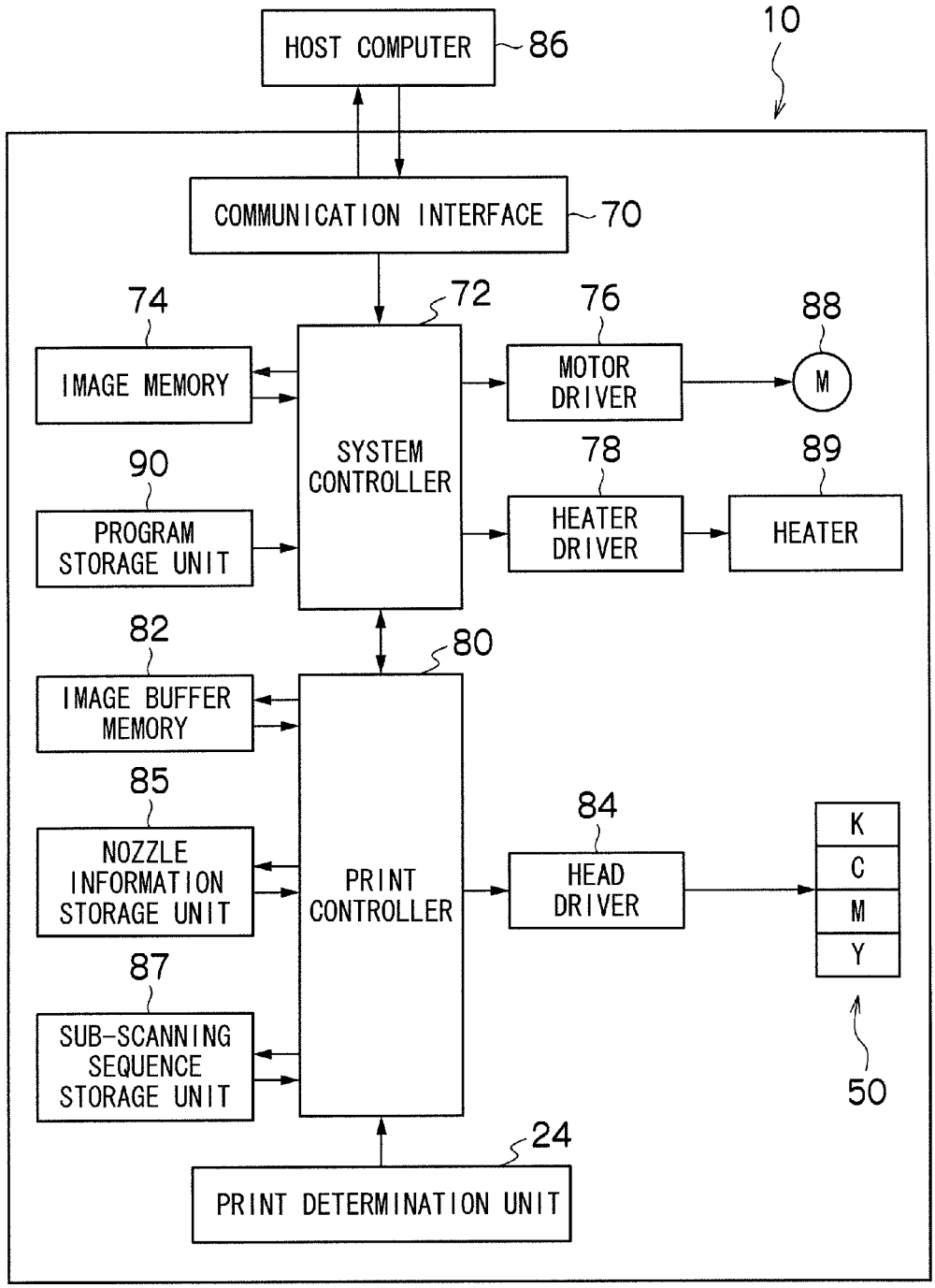
FIG. 6 is a principal block diagram showing the system configuration of the inkjet recording apparatus shown in FIG. 1.

FIG. 6 is a principal block diagram showing the system configuration of the inkjet recording apparatus 10. The inkjet recording apparatus 10 includes a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface or a parallel interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit which controls the respective sections, such as the communications interface 70, the image memory 74, the motor driver 76, the heater driver 78, and the like. The system controller 72 is made up of a central processing unit (CPU) and peripheral circuits thereof, and as well as controlling communications with the host computer 86 and controlling reading from and writing to the image memory 74, and the like, it generates control signals for controlling the motors 88 and heaters 89 in the conveyance system.

The motor driver (drive circuit) 76 drives the motor 88 in accordance with commands from the system controller 72.

The heater driver 78 drives the heater 89 of the post-drying unit 42 or other units in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (dot data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 6 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 generates drive signals for driving the heaters 58 (or piezoelectric elements 58') of the recording heads 50 of the respective colors, on the basis of dot data supplied from the print controller 80, as well as supplying the generated drive signals to the heaters 58 (or piezoelectric elements 58'). A feedback control system for maintaining constant drive conditions in the head 50 may be included in the head driver 84.

The print determination unit 24 reads in a test pattern recorded by the head 50 and performs prescribed signal processing, and the like, to determine the ink ejection status of the head 50 (presence or absence of ejection, dot size, dot position, and the like). The determination results are stored in a nozzle information storage unit 85. According to requirements, the print controller 80 makes various corrections with respect to the head 50 on the basis of information stored in the nozzle information storage unit 85.

The information stored in the nozzle information storage unit 85 includes information about the presence or absence of an ejection abnormality in each nozzle (ejection abnormality nozzle information), and information about the intrinsic ejection characteristics of each nozzle (nozzle locality information). The nozzle locality information includes variation in the ejection amount, variation in the ejection direction and variation in the ejection position (nozzle forming position).

The sub-scanning sequence storage unit 87 is a storage block which stores a sequence of amounts of movement (feed amounts) in the sub-scanning direction as determined in accordance with the combination of nozzles which perform image recording of the same main scanning line. As described in more detail hereinafter, in the image recording method described in the present embodiment, a combination of a plurality of feed actions in the sub-scanning direction is taken as one sub-scanning sequence, and by repeating this sub-scanning sequence, image recording that is free of omissions is performed.

A plurality of the sub-scanning sequences described above are stored in the sub-scanning sequence storage unit 87, and on the basis of the information in the nozzle information storage unit 85, the print controller 80 determines the combination of nozzles which are to perform image recording of the same main scanning line, selects a sub-scanning sequence corresponding to that combination of nozzles, and controls feed in the sub-scanning direction accordingly.

Various control programs are stored in the program storage unit 90, and a control program is read out and executed in accordance with commands from the system controller 72. The program storage unit 90 may use a semiconductor memory, such as a ROM, EEPROM, or a magnetic disk, or the like. An external interface may be provided, and a memory card or PC card may also be used. Naturally, a plurality of these recording media may also be provided. The program storage unit 90 may also be combined with a storage device for storing operational parameters, and the like (not illustrated).

Description of Image Recording Method

Next, the image recording method employed in the inkjet recording apparatus 10 is described in detail with reference to a concrete example.

The image recording method described in the present embodiment employs an interlace method and a multi-scan method. Taking the number of overwrites on one main scanning line (the number of multi-scans) to be s, and taking the recording density (dpi) in the sub-scanning direction to be k times the nozzle density D (dpi) in the sub-scanning direction, the sub-scanning sequence is made up of s×k sub-scanning feed actions. In other words, taking the total number of nozzles to be n, and taking the total amount of movement in the sub-scanning direction within the sub-scanning sequence to be P, then P can be expressed as $P=n/D=P_1+P_2+\ldots+P_{s\times k}$.

Furthermore, in the image recording method described in the present embodiment, nozzle information is acquired for each nozzle from the nozzle information storage unit 85 (see FIG. 6), a combination of nozzles for performing image recording of the same main scanning line is determined on the basis of this nozzle information, and a sub-scanning sequence ($P_1$, $P_2$, . . . , $P_{s\times k}$) corresponding to this combination of nozzles is selected. The nozzle information includes information about whether or not there is a nozzle suffering an ejection abnormality, information on divergence in the ejection direction, divergence in the ejection position, and error in the ejection volume.

Figure 7:
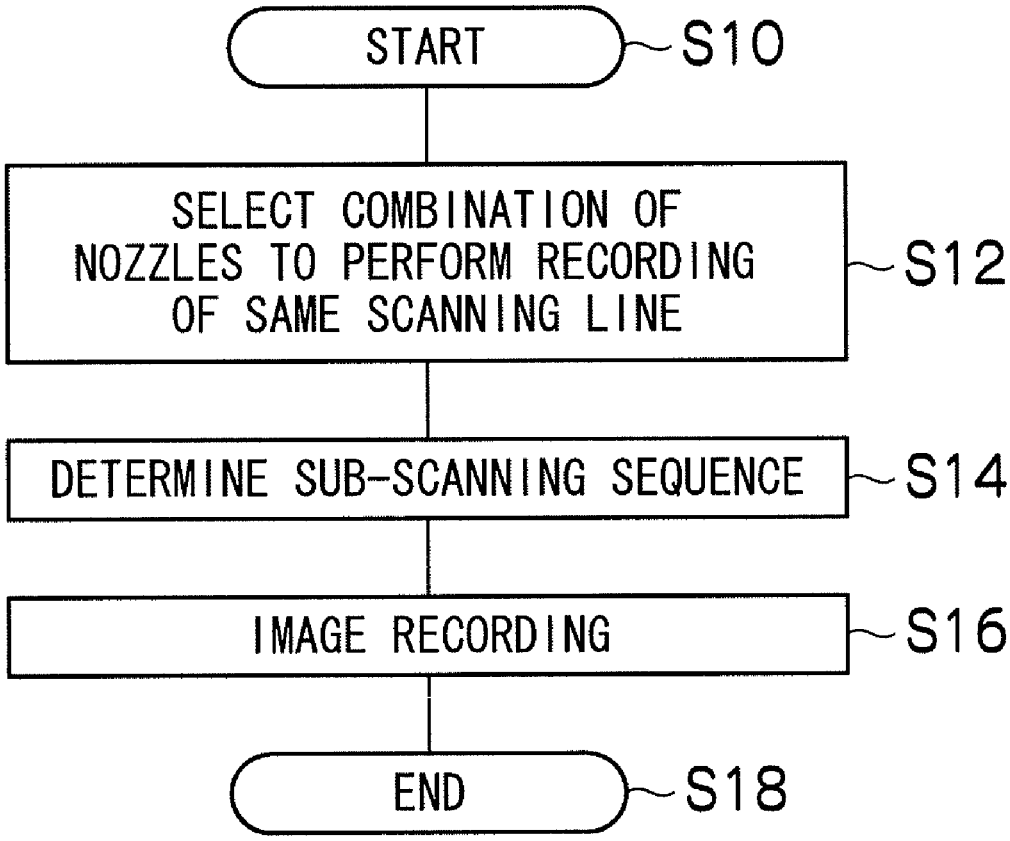
FIG. 7 is a flowchart of an image recording method according to an embodiment of the present invention.

FIG. 7 is a flowchart showing the principal steps of the image recording method described in the present embodiment. As shown in FIG. 7, in the image recording method described in the present embodiment, firstly the combination of nozzles that are to carry out recording of the same main scanning line is determined by referring to the nozzle information stored in the nozzle information storage unit 85 (see FIG. 6) (step S12 in FIG. 7). When the combination of nozzles that are to perform recording of the same main scanning line has been determined in step S12, the sub-scanning sequence corresponding to that combination of nozzles is selected (step S14). When the sub-scanning sequence has been selected in step S14, the feed in the sub-scanning direction is controlled on the basis of this sub-scanning sequence and image recording is carried out (step S16).

In other words, by designating the method of controlling sub-scanning feed in accordance with the status of the nozzles, it is possible to achieve processing which isolates a nozzle that has suffered a decline in ejection functionality. Furthermore, it is also possible to combine the use of processing for carrying out complementary recording by using further nozzles which record at positions adjacent to the recording position of the nozzle. Furthermore, it is also possible to carry out image recording using a multi-pass method in which nozzles having substantially the same ejection speed are aligned on the same main scanning line, and by carrying out image recording of this kind, it is possible to restrict variation in the landing positions to within a prescribed range, without individually controlling the ejection timings of the ejected droplets (dots) which are aligned on the same main scanning line.

The sub-scanning sequence described above is selected appropriately when a nozzle suffering an ejection abnormality has occurred, or when it is necessary to change the sub-scanning sequence due to a change in the ejection characteristics of the nozzles.

Figure 8:
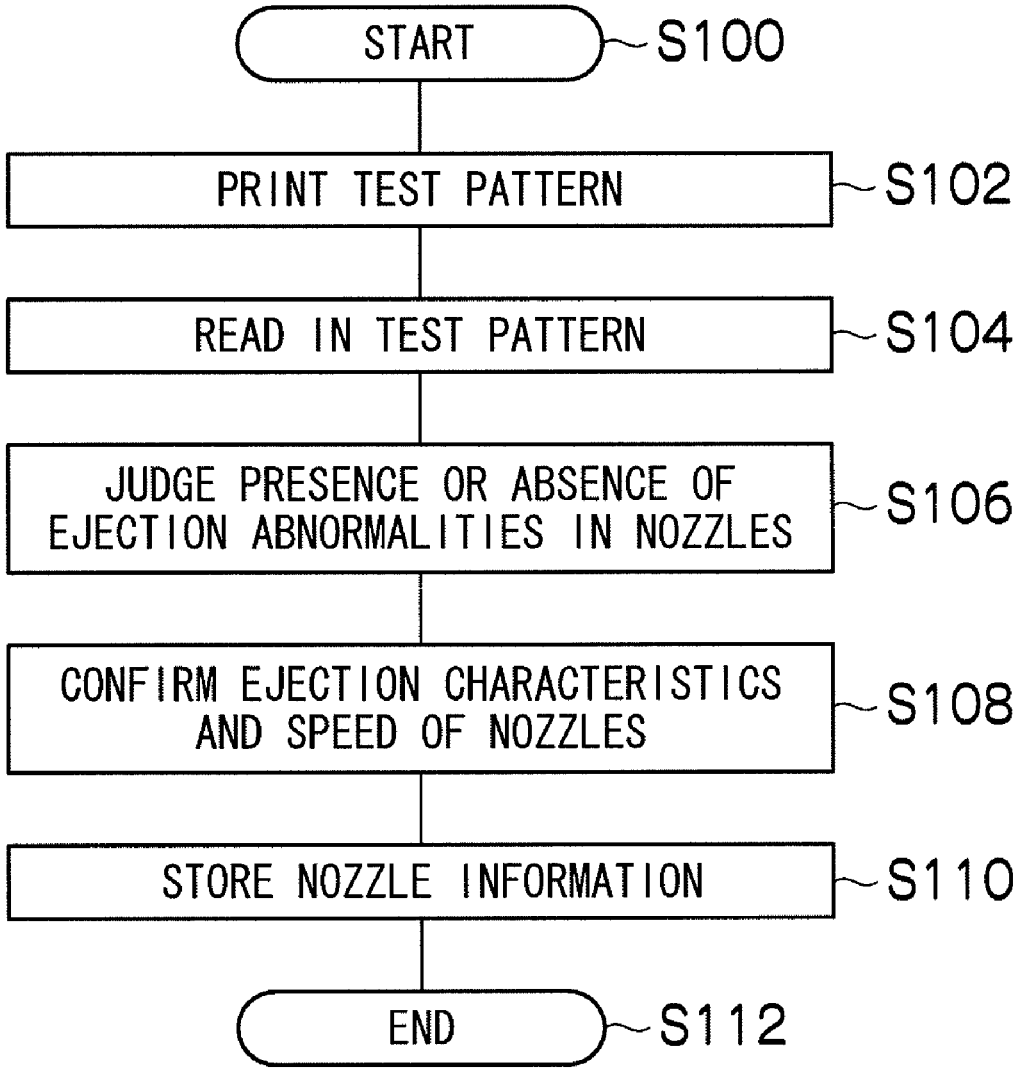
FIG. 8 is a flowchart showing a procedure for storing nozzle information.

Next, the procedure until storing nozzle information in the nozzle information storage unit 85 will be described. FIG. 8 is a flowchart showing the procedure until the storing of nozzle information. Firstly, a test pattern is printed using the print unit 12 (step S102).

The test pattern serves to confirm the presence or absence of ejection abnormality in any of the nozzles, as well as confirming the ejection speed in each of the nozzles. The test pattern described in the present embodiment has a plurality of patterns which use a plurality of sub-scanning sequences. For example, in a head having n=1024 nozzles, taking the number of multi-scans as S=2, and taking the ratio of the recording density in the sub-scanning direction with respect to the nozzle density D in the sub-scanning direction to be k=2, then if one sub-scanning sequence is composed by s×k=4 sub-scanning actions, and if the combination of the recording position numbers $A_1$ to $A_4$ in the sub-scanning direction as expressed by $A_1=P_1\times D\times k$, $A_2=P_2\times D\times k$, $A_3=P_3\times D\times k$, $A_4=P_4\times D\times k$ is taken to be ($A_1$, $A_2$, $A_3$, $A_4$), then the test pattern is formed by including patterns for each combination of recording position numbers.

Possible examples of the combination of recording position numbers $A_1$ to $A_4$ in the sub-scanning direction ($A_1$, $A_2$, $A_3$, $A_4$) are (511, 511, 511 515) or (513, 513, 513, 509), for instance. The combination ($A_1$, $A_2$, $A_3$, $A_4$) of the recording position numbers $A_1$ to $A_4$ in the sub-scanning direction comprises either all odd numbers, or alternate odd numbers and even numbers, which satisfy $A_1+A_2+A_3+A_4=P\times D\times k=2048$.

Next, the test pattern containing a plurality of sub-scanning sequences is read in (step S104), the presence or absence of ejection abnormality is judged in respect of each of the nozzles (step S106) and the ejection speed (ejection characteristics) is confirmed (step S108).

The test pattern is read in by using the print determination unit 24 shown in FIG. 6, and the reading result is stored in the nozzle information storage unit 85 in FIG. 6 (step S110). The presence of absence of a dot, the dot position, the dot size, the dot shape, and the like, are measured in respect of the dots which constitute the test pattern, and the presence or absence of an ejection abnormality is judged in respect of each nozzle.

If a nozzle suffering an ejection abnormality is present, then the ejection abnormality nozzle is isolated. Here, isolation means that the ejection abnormality nozzle is not used and a sub-scanning sequence is selected in such a manner that the droplet ejection that was originally to have been performed by the ejection abnormality nozzle is performed by other normal nozzles.

Furthermore, the confirmation of the droplet ejection speed (ejection characteristics) of the nozzles in step S108 can be made by analyzing the correlation between the droplet ejection positions of the adjacent nozzles in the test pattern reading results. As described above, since the test pattern includes patterns corresponding to a plurality of sub-scanning sequences, then it is possible to judge which of the patterns produces the smallest non-uniformity and to select the sub-scanning sequence corresponding to that pattern.

In other words, by printing a test pattern using a plurality of sub-scanning sequences as described above, the combination of nozzles which undertake droplet ejection on the same main scanning line in a multi-pass method are varied, and therefore it is possible to find the optimum combination of nozzles which do not have mutually conspicuous intrinsic nozzle non-uniformities, such as ejection speed, ejection direction, or the like.

According to an image recording method having the composition described above, in image recording using a serial method which employs an interlace method and a multi-pass method, the state of nozzles provided in a recording head is judged, the combination of nozzles which perform recording of the same main scanning line is selected, a sub-scanning sequence corresponding to this combination of nozzles is determined, and feeding in the sub-scanning direction is controlled on the basis of this sub-scanning sequence, and therefore decline in the image quality caused by ejection abnormalities in the nozzles and variation in ejection characteristics is prevented.

Furthermore, it is also possible to maintain uniform production efficiency, without any significant reduction in the number of nozzles used in image recording.

Concrete Example of Isolation of Nozzle Suffering Ejection Abnormality

Next, a concrete example of the isolation of a nozzle suffering ejection abnormality will be described. In the image recording method described below, image recording is carried out by not using an ejection abnormality nozzle and by designating a nozzle located in a symmetrical position to the ejection abnormality nozzle in the sub-scanning direction as a quasi-abnormal nozzle and not using this nozzle.

If the nozzle at one end of the recording head is taken as the first nozzle and numbers are assigned in sequence to the n nozzles in the sub-scanning direction, then if the i-th nozzle is suffering an ejection abnormality, the "quasi-abnormal nozzle" will be the (n−(i−1))-th nozzle.

Figure 9:
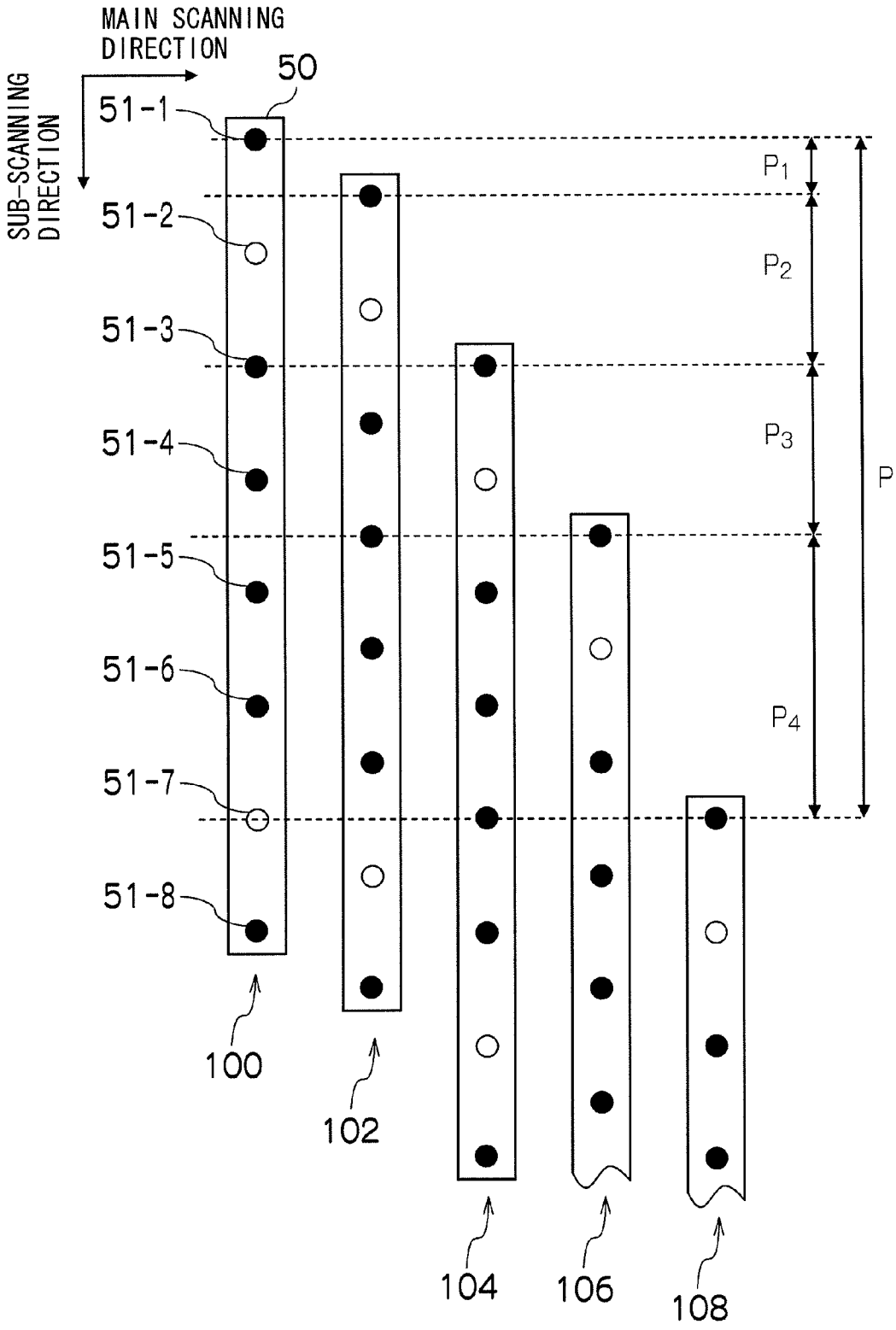
FIG. 9 is a schematic drawing showing one example of an image recording method according to an embodiment of the present invention.

FIG. 9 is a diagram describing the feed amount in the sub-scanning direction when n=8 and i=7, and the upper end nozzle 51-1 of the head 50 in FIG. 9 is taken as the first nozzle. Furthermore, the seventh nozzle 51-7 is an ejection abnormality nozzle, and the second nozzle 51-2, which is the quasi-abnormal nozzle, is not used in image recording.

In the image recording method described in the present embodiment, a multi-pass method and an interlace method are used in combination, and taking the total number of nozzles to be n, taking the number of nozzles excluding the ejection abnormality nozzles and the quasi-abnormal nozzles from the whole nozzles to be n', and taking the nozzle density to be D (dpi), recording is carried out at the nozzle density D without producing gaps by conveying the head 50 and the recording paper 16 relatively through the movement amount P (=n'/D) in the sub-scanning direction.

In this case, taking the number of multi-passes (the number of overwrites on the same main scanning line) to be s (where s is an integer greater than 1), taking the ratio of the recording density in the sub-scanning direction with respect to the nozzle density D in the sub-scanning direction (the recording density ratio=recording density/nozzle density D) to be k, and taking the amount of movement P in the sub-scanning direction in one sub-scanning sequence to be the sum of the s×k movements, then the relationship between the number of nozzles n' and the amount of movement P in the sub-scanning direction in one sequence ($=P_1+P_2+\ldots+P_{s\times k}$) is expressed by the following formula (1):

$$n'=(P_1+P_2+\ldots+P_{s\times k})\times D \quad (1)$$

In other words, the head 50 and the recording paper 16 are conveyed relatively through P (=n'/D) as the sum total of the s×k movements in the sub-scanning direction, by the recording in one sub-scanning sequence. As a result of this, the nozzle 51-1 which carries out complementary droplet ejection at the position of the ejection abnormality nozzle 51-7 is moved.

The amounts of movement in the sub-scanning direction in one sub-scanning sequence, $P_1, P_2, \ldots, P_{s\times k}$, are selected in advance in such a manner that the remainder of dividing ($P_1\times D\times k$) by k, the remainder of dividing (($P_1+P_2$)×D×k) by k, . . . , and the remainder of dividing (($P_1+P_2+\ldots+P_{s\times k}$)×D×k) by k are established by the s combinations from 0 to k−1.

In other words, the position in the sub-scanning direction where recording is carried out in the main scanning direction (the main scanning recording position) includes positions which coincide with the nozzle position in the sub-scanning direction (nozzle position) and positions between mutually adjacent nozzle positions, and there are k−1 main scanning recording positions between the nozzle positions. When the total amount of movement until each main scanning recording position is multiplied by (D×k) and then divided by k, if the remainder of the resulting value is 0, then this means that the position is a nozzle position, and if the remainder is 1 to k−1, then this means that the position is one between nozzle positions.

In FIG. 9, for the sake of convenience, it is supposed that the head 50 is moved in the sub-scanning direction (the downward direction in FIG. 9), and the head 50 at its respective halt positions (indicated by reference numerals 100 to 108) is depicted as staggered in the lateral direction in FIG. 9.

In the example shown in FIG. 9, it is supposed that the nozzle 51-1 is moved to the position of the ejection abnormality nozzle 51-7 by passing through four movements in the sub-scanning direction, and the four amounts of movement in the sub-scanning direction are $P_1$=0.5/D, $P_2$=1.5/D, $P_3$=1.5/D, $P_4$=2.5/D. In other words, the feed amount Pin the sub-scanning direction in one sequence is $P=P_1+P_2+P_3+P_4$=6/D.

When a first recording action in the main scanning direction has been performed at the position denoted with reference numeral 100 (a reference position in the sub-scanning direction, nozzle position), then the head 50 and the recording paper (not shown in FIG. 9) are moved relatively through the movement amount $P_1$ in the sub-scanning direction, and a second recording action in the main scanning direction is carried out at the position denoted with reference numeral 102. This position is a position between the nozzle positions (intermediate position).

After the second recording action in the main scanning direction, the head 50 and the recording paper are conveyed relatively through $P_2$ in the sub-scanning direction, and a third recording action in the main scanning direction is carried out at the position denoted with reference numeral 104. This position is a nozzle position.

After the third recording action in the main scanning direction, the head 50 and the recording paper are conveyed relatively through $P_3$ in the sub-scanning direction, and a fourth recording action in the main scanning direction is carried out at the position denoted with reference numeral 106. This position is a nozzle position. Thereupon, the head 50 and the recording paper are conveyed relatively through $P_4$ in the sub-scanning direction.

In this way, by performing four movements of the movement amounts $P_1$ to $P_4$ in the sub-scanning direction, the nozzle 51-1 is moved to a position for complementing the ejection abnormality nozzle 51-7. The movement in the sub-scanning direction until this point is taken as one sequence, and this sequence is carried out repeatedly. In other words, in the movement in the sub-scanning direction in one sequence, the main scanning recording position when s=2 and k=2 will be s×k (=4), and a nozzle position and an intermediate position are repeatedly alternately, every s (=2) times.

Figure 10:
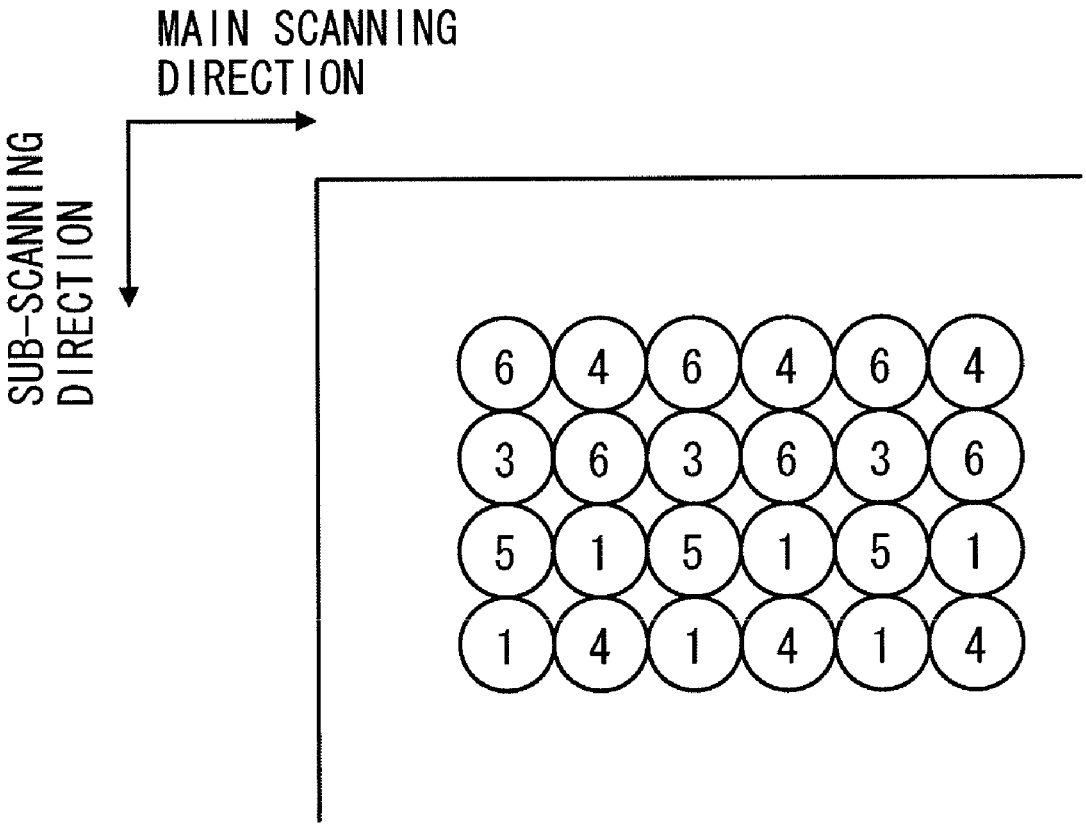
FIG. 10 is a diagram showing an example of a dot arrangement recorded by the image recording method shown in FIG. 9.

FIG. 10 is a diagram showing the dot arrangement recorded onto the recording paper 16 by means of the recording method described above. In FIG. 10, the numerals indicated inside the dots 100 represent nozzle numbers n (1 to 8) forming the dots.

In the third dot row from the top in FIG. 10, the droplet ejection of nozzle 51-7 is compensated for by nozzle 51-1, and a combination of nozzle 51-1 and nozzle 51-5 is selected. In other words, the combination of nozzles in each main scan is determined in such a manner that the ejection abnormality nozzle 51-7 is not used.

Here, the remainders of the following formulas (2) to (5) are determined specifically as indicated below:

$$(P_1\times D\times k)/k \quad (2)$$

$$\{(P_1+P_2)\times D\times k\}/k \quad (3)$$

$$\{(P_1+P_2+P_3)\times D\times k\}/k \quad (4)$$

$$\{(P_1+P_2+P_3+P_4)\times D\times k\}/k \quad (5)$$

The remainder of the formula (2) is 1 (intermediate position), the remainder of the formula (3) is 0 (nozzle position), the remainder of the formula (4) is 1 (intermediate position), and the remainder of the formula (5) is 0. In other words, the respective movement positions 102 to 108 in the sub-scanning direction are a combination of s (=2) positions having values of 0 and k−1 (=1) for the remainder obtained by multiplying the nozzle density D by the total amount of movement from the reference position 100 to that movement position, multiplying the resulting product by a coefficient k and then dividing the resulting product by k. In this way, the s×k movements $P_1$ to $P_{s\times k}$ in the sub-scanning direction are selected.

Figure 11:
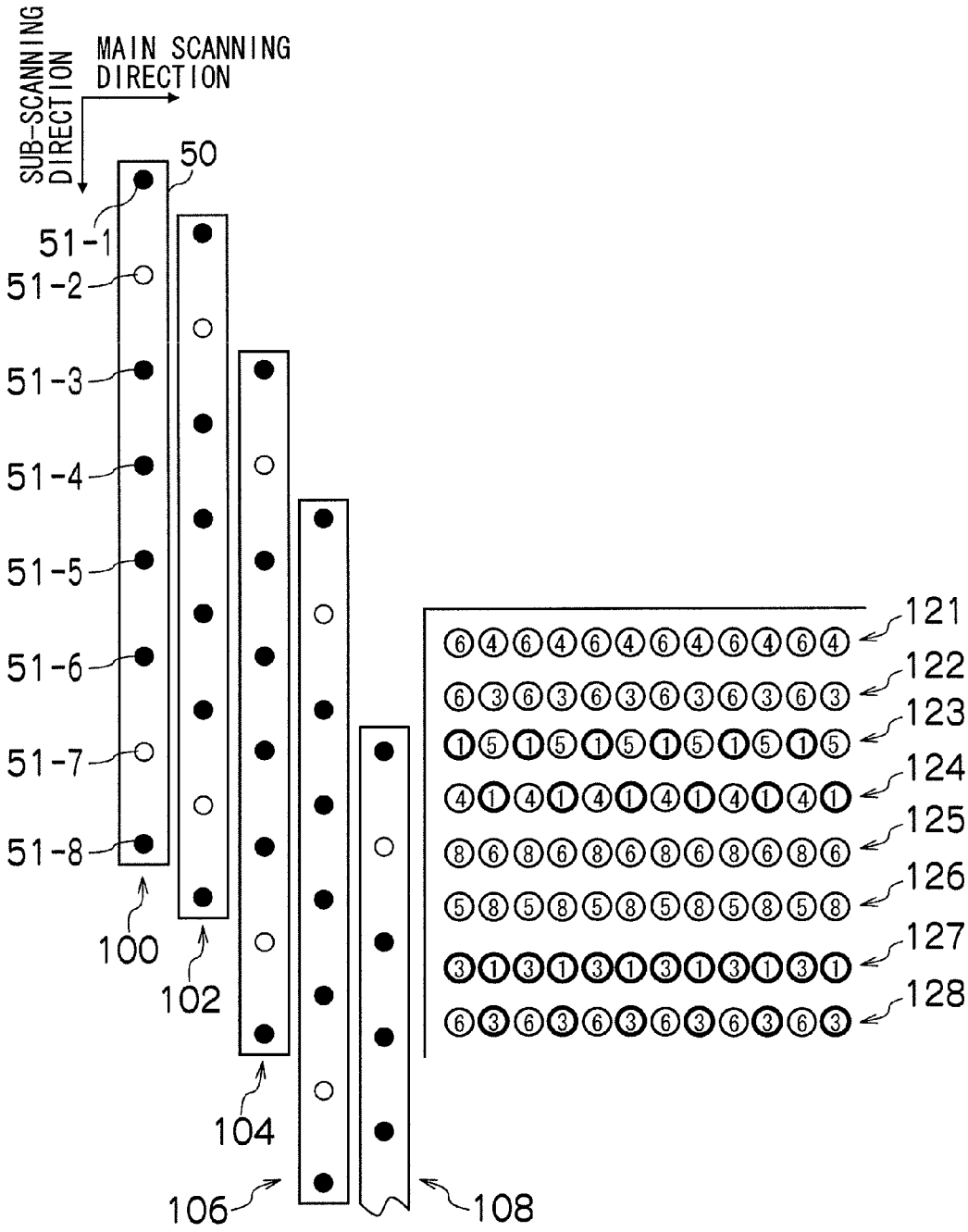
FIG. 11 is a diagram showing an example of recording of the end portion of recording paper in the image recording method shown in FIG. 9.

In the leading edge portion or the trailing edge portion of the recording paper 16, recording is carried out by using a portion of the nozzles 51-1 to 51-8. FIG. 11 is an explanatory diagram which explains an example of recording at the leading edge portion of the recording paper 16.

In FIG. 11, in recording in the main scanning direction at the position denoted with reference numeral 100, the nozzle 51-6 and the nozzle 51-8 are used, and the first dot row 121 and the fifth dot row 125 are recorded. In recording in the main scanning direction at the position denoted with reference numeral 102, the nozzle 51-6 and the nozzle 51-8 are used, and the second dot row 122 and the sixth dot row 126 are recorded.

In the recording in the main scanning direction at the position denoted with reference numeral 104, the nozzles 51-4, 51-5, 51-6 and 51-8 are used, and the first dot row 121, the third dot row 123, the fifth dot row 125 and the ninth dot row (not illustrated) are recorded. Since the seventh dot row 127 corresponds to the ejection abnormality nozzle 51-7, then it is not recorded.

In the recording in the main scanning direction at the position denoted with reference numeral 106, the nozzles 51-3 to 51-6 and 51-8 are used, and the second dot row 122, the fourth dot row 124, the sixth dot row 126, the eighth dot row 128 and the twelfth dot row (not illustrated) are recorded. Since the tenth dot row (not illustrated) corresponds to the ejection abnormality nozzle 51-7, then it is not recorded.

Next, the missing portion of the third dot row 123, and the seventh dot row 127 are recorded, by recording in the main scanning direction at the position denoted with reference numeral 108. The dots recorded in this case are depicted by thick lines. In the next recording in the main scanning direction (the position of the head 50 is not depicted), the dots of the missing portion of the fourth dot row 124 and the missing portion of the eighth dot row 128 are recorded, and in the next recording in the main scanning direction, the dots of the missing portion of the seventh dot row 127 are recorded.

In this way, by selectively using the nozzles 51-1 to 51-8 to record the leading edge portion (and trailing edge portion) of the recording paper 16, it is possible to record dots without any omissions.

In respect of the recording density ratio k, if k=3, then there will be two positions between the nozzle positions, and if k=4, then there will be three positions between the nozzle positions. Furthermore, in respect of the number of multi-scans s, if s=3, then there will respectively be three nozzle positions and three positions between the nozzle positions in one sequence of movements in the sub-scanning direction, and if k=4, then there will respectively be four nozzle positions and four positions between the nozzle positions in one sequence of movements in the sub-scanning direction.

Next, the hypothetical case of an actual head composition where n'=1024 and D=600 (dpi) will be described. The recording density in the sub-scanning direction is D×k (=600×2)=1200 dpi, one main scanning line is scanned s (=2) times each, the paper is conveyed relatively through P (=n'/D=1024/600 dpi) by s×k (=4) movements in the sub-scanning direction, and the complement in respect of an ejection abnormality nozzle 51-2 and a quasi-abnormal nozzle 51-7 is established. The amounts of movement in the sub-scanning direction are $P_1$, $P_2$, $P_3$, $P_4$, this sequence being repeated.

From the above-described formula (1), the amounts of movement P1, P2, P3, P4 in the sub-scanning direction satisfy $(P_1+P_2+P_3+P_4)\times D=n'=1024$. In other words, if the numbers of recording positions $A_1$, $A_2$, $A_3$, $A_4$ corresponding to the respective amounts of movement $P_1$, $P_2$, $P_3$, $P_4$ in the sub-scanning direction are considered, then $P_1=\{A_1/(D\times k)\}$, $P_2=\{A_2/(D\times k)\}$, $P_3=\{A_3/(D\times k)\}$, $P_4=\{A_4/(D\times k)\}$. For example if $A_1=511$, $A_2=511$, $A_3=513$ and $A_4=513$, then the remainders obtained when these values are divided by k (=2) are respectively 1, 0, 1, 0. In other words, when the number of recording positions corresponding to the amounts of movement in the sub-scanning direction is divided by D×k, the remainders are combinations of two pieces of 0 or 1. Furthermore, $A_1+A_2+A_3+A_4$ is the number of recording positions corresponding to the total amount of movement in the sub-scanning direction in one sequence, and is equal to n'×k (=2048).

If k=2, then it is possible that the numbers of recording positions $A_1$, $A_2$, $A_3$, $A_4$ corresponding to the amounts of movement in the sub-scanning direction are all odd numbers and the total of these is n'×k.

Furthermore, if k=2, then it is also possible that the numbers of recording positions $A_1$, $A_2$, $A_3$, $A_4$ corresponding to the amounts of movement in the sub-scanning direction are repeated odd numbers and even numbers and the total of these is n'×k.

In this way, if sub-scanning sequences are determined in advance for respective combinations of nozzles which perform recording of the same main scanning line and are stored in the sub-scanning sequence storage unit 87 in FIG. 6 in association with the combination of nozzles performing recording of the same main scanning line, then when the combination of nozzles which are to perform recording of the same main scanning line has been decided at step S12 in FIG. 7, the sub-scanning sequence is selected by referring to the sub-scanning sequence storage unit 87.

As described above, by establishing a symmetrical nozzle arrangement pattern in which the quasi-abnormal nozzle located in a symmetrical position in the sub-scanning direction with respect to the ejection abnormality nozzle is not used, the sub-scanning sequence is prevented from becoming complicated.

Application Embodiment of Matrix Head

In the embodiment described above, image recording using the serial scanning type of head having the single nozzle row in the sub-scanning direction has been described, but the image recording method according to the present invention can also be applied to image recording using a head having nozzles arranged in a matrix configuration.

Figure 12:
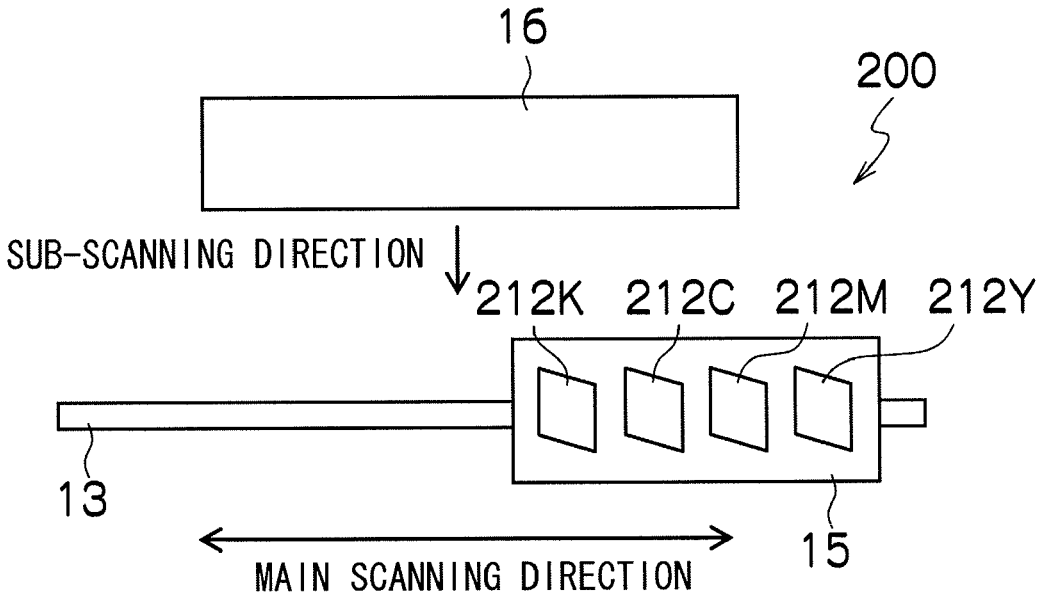
FIG. 12 is a block diagram showing an example of an apparatus composition when a matrix configuration is employed.

FIG. 12 is a general schematic drawing of the inkjet recording apparatus 200 according to the present application embodiment. In the following description, parts which are the same as or similar to the drawings described previously are denoted with the same reference numerals and further explanation thereof is omitted here.

The inkjet recording apparatus 200 shown in FIG. 12 has heads 212K, 212C, 212M and 212Y corresponding to the respective colors K, C, M, Y mounted on the carriage 15, and the heads 212K, 212C, 212M and 212Y each having nozzles (not shown in FIG. 12) arranged in a matrix configuration. The heads 212K, 212C, 212M and 212Y are head modules equivalent to head modules constituting full line heads, and are arranged at a 90° rotation with respect to a case where they are used in full line heads.

Figure 13:
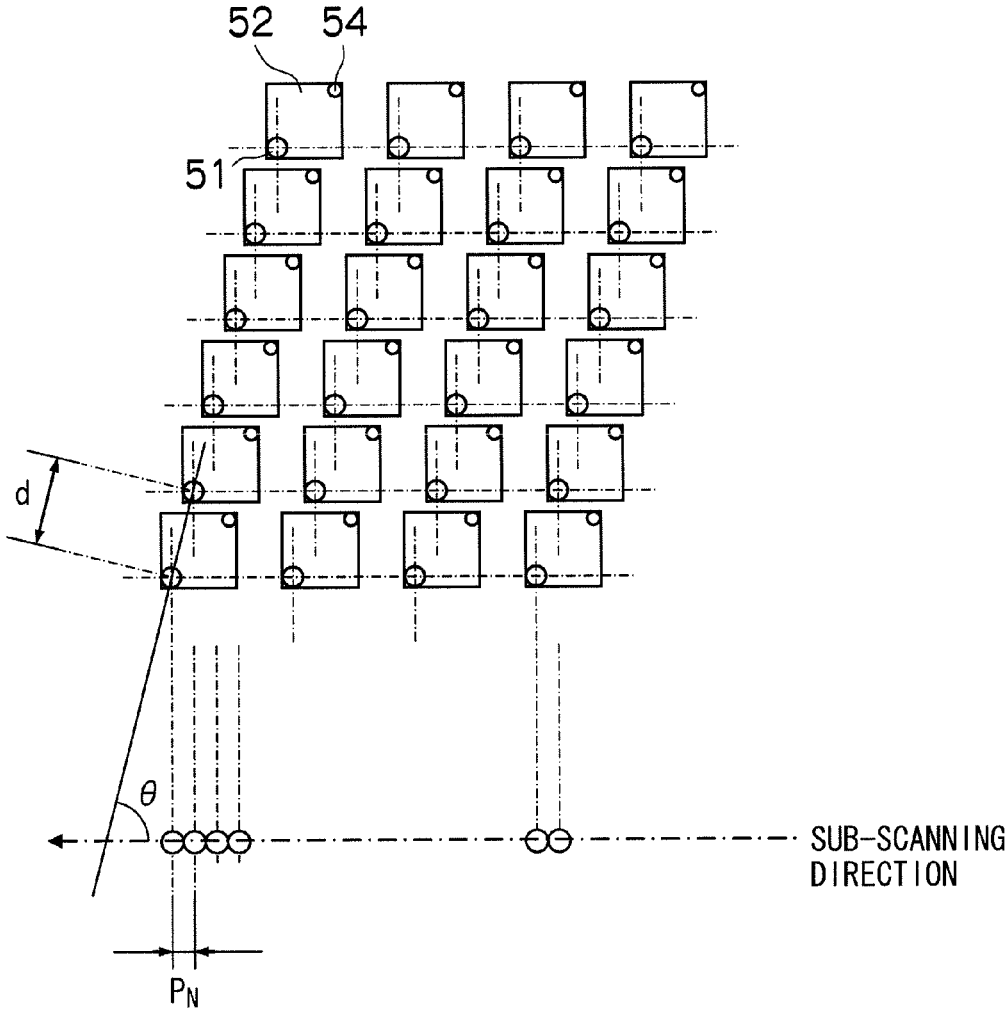
FIG. 13 is a diagram illustrating the matrix configuration.

Next, the matrix arrangement of the nozzles will be described. FIG. 13 is a plan diagram showing an example of the arrangement of nozzles in one of the heads 212K, 212C, 212M and 212Y, and depicts a portion of the head in enlarged view.

As shown in FIG. 13, a high-density nozzle arrangement is achieved by arranging the plurality of nozzles 51 in a lattice according a fixed arrangement pattern following a row direction along the sub-scanning direction and an oblique column direction that forms a non-perpendicular set angle of θ with respect to the sub-scanning direction.

More specifically, by adopting a structure in which the nozzles 51 are arranged at a uniform pitch d in line with the direction forming the certain angle of θ with respect to the sub-scanning direction, the pitch P of the nozzles projected to an alignment in the sub-scanning direction is d×cos θ, and hence it is possible to treat the nozzles 51 as if they were arranged linearly at a uniform pitch of $P_N$.

In other words, considering a nozzle row in which the nozzles arranged in the matrix configuration are projected to an alignment in a single row following the sub-scanning direction as in FIG. 13, it is possible to treat the nozzles as being equivalent to the nozzle arrangement in FIG. 5, and hence the image recording method described above can be applied.

In the above-described embodiments, the inkjet recording apparatus which forms color images by ejecting ink from nozzles has been described as an example; however, the present invention can also be applied to electrophotography which uses recording elements such as LEDs.

As has become evident from the detailed description of the embodiment of the present invention given above, the present specification includes disclosure of various technical ideas including at least the following aspects of the present invention.

In an aspect of the present invention, an image recording apparatus includes: a recording head which has at least one row of recording elements arranged at a prescribed arrangement interval in a sub-scanning direction; a scanning device which moves the recording head in a main scanning direction so as to perform recording of a same main scanning line by means of a plurality of scans in the main scanning direction with respect to a recording medium; a conveyance device which conveys the recording head and the recording medium relatively to each other in the sub-scanning direction; a recording control device which controls the recording head to perform recording by using at least two of the recording elements in the recording of the same main scanning line; a recording element selection device which selects a combination of the recording elements to perform recording of the same main scanning line in accordance with a status of each of the recording elements; and a conveyance control device which determines a combination of feed amounts in the sub-scanning direction corresponding to the combination of the recording elements selected by the recording element selection device and controls the conveyance device in accordance with the determined combination of feed amounts in the sub-scanning direction According to this aspect of the present invention, in image recording based on a multi-pass method which performs recording of the same main scanning line by means of a plurality of scans, since a combination of nozzles to perform recording of the same main scanning line is selected in accordance with the status of the recording elements and since the feed in the sub-scanning direction is controlled in accordance with the selected combination of nozzles, then the defect rate of the recording head is reduced and decline in the quality of the recorded image is prevented.

The recording element is a concept which includes a composition having a nozzle, a liquid chamber accommodating liquid to be ejected from the nozzle, and a pressurization element which applies pressure to the liquid inside the liquid chamber.

The status of the recording element is a concept including the status in terms of whether or not the element is operable, the variation in the recording position, and the variation in the recording volume.

Preferably, the image recording apparatus further comprises: a reading device which reads a test pattern formed with the recording elements; and a storage device which stores the status of the recording elements judged according to reading results of the reading device, wherein the recording element selection device selects the combination of the recording elements that perform recording of the same main scanning line by referring to the status of the recording elements stored in the storage device.

According to this aspect of the present invention, since the status of the recording elements as judged on the basis of the reading results of a prescribed test pattern are stored in advance, then the recording element selection device is able to refer to the recorded contents.

Preferably, the test pattern includes patterns of a plurality of types having different combinations of the recording elements that perform recording of the same main scanning line.

According to this aspect of the present invention, it is possible to select as the combination of recording elements to perform recording of the same main scanning line a combination of nozzles which form the most desirable pattern, of the plurality of patterns included in the test pattern.

Preferably, the recording element selection device selects the combination of the recording elements to perform recording of the same main scanning line so as not to use an abnormal one of the recording elements.

According to this aspect of the present invention, by omitting to use a recording element that has become abnormal, it is possible to reduce decline in image quality which is caused by the occurrence of the abnormal recording element.

Preferably, the recording element selection device selects recording elements having mutually similar recording characteristics as the recording elements to perform recording of the same main scanning line.

In this aspect of the present invention, recording elements having similar recording characteristics is a concept which includes elements having approximately the same direction and amount of divergence in the recording position.

For example, if the recording characteristics are different rather than being similar, then periodic divergence in the recording positions occurs, and this results in band-shaped density non-uniformities, but by performing recording of the same main scanning line using recording elements which have similar recording characteristics, periodic divergence in the recording position is suppressed and consequently the occurrence of band-shaped density non-uniformities is suppressed.

Preferably, where s is a number of multiple passes which is a number of recording actions on the same main scanning line, D is an arrangement density of the recording elements expressed as a number of the recording elements per unit length, and k is a ratio of a recording density in the sub-scanning direction with respect to the arrangement density D of the recording elements, the conveyance control device controls the conveyance device in such a manner that at least one of the recording head and the recording medium is moved by repeating a sub-scanning sequence constituted of s×k movements in the sub-scanning direction, and a remainder that is obtained by multiplying a total amount of movement to each of the s×k movements in the sub-scanning direction by the arrangement density D of the recording elements and multiplying a resulting product by the recording density ratio k, and then dividing a resulting product by the recording density ratio k, becomes a combination of values from 0 to k−1 that are equal in number to the number of multiple passes s.

According to this aspect of the present invention, in image recording using a multi-pass method comprising s multiple passes, and an interlace method having a recording density ratio of k in the sub-scanning direction with respect to the arrangement density D of the recording elements, it is possible to select an optimum sub-scanning sequence.

The recording element density and the recording density can be expressed as dpi indicating units of the number of recording elements per inch.

Preferably, when the recording density ratio k upon recording the same main scanning line is 2, then values $(P_1 \times D \times k)$, $(P_2 \times D \times k)$, . . . , $(P_{s \times k} \times D \times k)$, which are obtained by multiplying each of the s×k amounts of movement $P_1, P_2, \ldots, P_{s \times k}$ in the sub-scanning direction by the arrangement density D of the recording elements and then multiplying a resulting product by the recording density ratio k, are either all odd numbers or alternating odd numbers and even numbers.

According to this aspect of the present invention, if s=2 and k=2, then taking the respective amounts of movement in the sub-scanning direction to be $P_1$, $P_2$, $P_3$ and $P_4$, the remainder of $(P_1 \times D \times k)/k$, the remainder of $\{(P_1+P_2 \times D \times k)\}/k$, the remainder of $\{(P_1+P_2+P_3) \times D \times k)\}/k$, and the remainder of $(P_1+P_2+P_3+P_4) \times D \times k)/k$, take a combination of two values, 0 or 1.

Preferably, the conveyance control device controls the conveyance device so as to satisfy P=n/D, where n is a number of the recording elements and P is a total amount of movement produced by the s×k movements in the sub-scanning direction.

The total amount of movement produced by the s×k movements in the sub-scanning direction can be expressed as $P=P_1+P_2+ \ldots +P_{s \times k}$.

Preferably, when an i-th recording element from one end of the recording head is an abnormal recording element, the recording element selection device does not select the i-th recording element from the one end of the recording head and an (n−(i−1))-th recording element from the one end of the recording head.

According to this aspect of the present invention, the control of the amounts of movement in the sub-scanning direction is prevented from becoming complicated.

In an aspect of the present invention, an image recording method comprises: a scanning step of moving a recording head in a main scanning direction so as to perform recording of a same main scanning line by means of a plurality of scans in the main scanning direction with respect to a recoding medium, the recording head having at least one row of recording elements arranged at a prescribed arrangement interval in a sub-scanning direction; a recording step of performing recording by using at least two of the recording elements in the recording of the same main scanning line; a recording element selection step of selecting a combination of the recording elements to perform recording of the same main scanning line in accordance with a status of each of the recording elements; and a conveyance step of determining a combination of feed amounts in the sub-scanning direction corresponding to the combination of the recording elements selected in the recording element selection step and conveying at least one of the recording head and the recording medium relatively to each other in accordance with the determined combination of feed amounts in the sub-scanning direction.

Preferably, the image recording method further comprises: a test pattern forming step of forming a test pattern with the recording elements; a reading step of reading the test pattern formed in the test pattern forming step; and a storing step of storing the status of the recording elements judged according to reading results of the reading step, wherein in the recording element selection step, the combination of the recording elements that perform recording of the same main scanning line is selected by referring to the status of the recording elements stored in the storing step.

Preferably, the test pattern includes patterns of a plurality of types having different combinations of the recording elements that perform recording of the same main scanning line.

Preferably, in the recording element selection step, the combination of the recording elements to perform recording of the same main scanning line is selected so as not to use an abnormal one of the recording elements.

Preferably, in the recording element selection step, recording elements having mutually similar recording characteristics are selected as the recording elements to perform recording of the same main scanning line.

Preferably, where s is a number of multiple passes which is a number of recording actions on the same main scanning line, D is an arrangement density of the recording elements expressed as a number of the recording elements per unit length, and k is a ratio of a recording density in the sub-scanning direction with respect to the arrangement density D of the recording elements, in the conveyance step, at least one of the recording head and the recording medium is moved by repeating a sub-scanning sequence constituted of s×k movements in the sub-scanning direction, and a remainder that is obtained by multiplying a total amount of movement to each of the s×k movements in the sub-scanning direction by the arrangement density D of the recording elements and multiplying a resulting product by the recording density ratio k, and then dividing a resulting product by the recording density ratio k, becomes a combination of values from 0 to k−1 that are equal in number to the number of multiple passes s.

Preferably, when the recording density ratio k upon recording the same main scanning line is 2, then values $(P_1 \times D \times k)$, $(P_2 \times D \times k)$, $(P_{s \times k} \times D \times k)$, which are obtained by multiplying each of the s×k amounts of movement $P_1, P_2, \ldots, P_{s \times k}$ in the sub-scanning direction by the arrangement density D of the recording elements and then multiplying a resulting product by the recording density ratio k, are either all odd numbers or alternating odd numbers and even numbers.

Preferably, in the conveyance step, the at least one of the recording head and the recording medium is moved so as to satisfy P=n/D, where n is a number of the recording elements and P is a total amount of movement produced by the s×k movements in the sub-scanning direction.

Preferably, in the recording element selection step, when an i-th recording element from one end of the recording head is an abnormal recording element, the i-th recording element from the one end of the recording head and an (n−(i−1))-th recording element from the one end of the recording head are not selected.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image recording apparatus, comprising:

a recording head which has at least one row of recording elements arranged at a prescribed arrangement interval in a sub-scanning direction;

a scanning device which moves the recording head in a main scanning direction so as to perform recording of a same main scanning line by means of a plurality of scans in the main scanning direction with respect to a recording medium;

a conveyance device which conveys the recording head and the recording medium relatively to each other in the sub-scanning direction; a recording control device which controls the recording head to perform recording by using at least two of the recording elements in the recording of the same main scanning line;

a recording element selection device which selects a combination of the recording elements to perform recording of the same main scanning line in accordance with a status of each of the recording elements; and a conveyance control device which determines a combination of feed amounts in the sub-scanning direction corresponding to the combination of the recording elements selected by the recording element selection device and controls the conveyance device in accordance with the determined combination of feed amounts in the sub-scanning direction, wherein, where s is a number of multiple passes which is a number of recording actions on the same main scanning line, D is an arrangement density of the recording elements expressed as a number of the recording elements per unit length, and k is a ratio of a recording density in the sub-scanning direction with respect to the arrangement density D of the recording elements, the conveyance control device controls the conveyance device in such a manner that at least one of the recording head and the recording medium is moved by repeating a sub-scanning sequence constituted of s×k movements in the sub-scanning direction, and a remainder that is obtained by multiplying a total amount of movement to each of the s×k movements in the sub-scanning direction by the arrangement density D of the recording elements and multiplying a resulting product by the recording density ratio k, and then dividing a resulting product by the recording density ratio k, becomes a combination of values from 0 to k−1 that are equal in number to the number of multiple passes s.

2. The image recording apparatus as defined in claim 1, further comprising:

a reading device which reads a test pattern formed with the recording elements; and a storage device which stores the status of the recording elements judged according to reading results of the reading device, wherein the recording element selection device selects the combination of the recording elements that perform recording of the same main scanning line by referring to the status of the recording elements stored in the storage device.

3. The image recording apparatus as defined in claim 2, wherein the test pattern includes patterns of a plurality of types having different combinations of the recording elements that perform recording of the same main scanning line.

4. The image recording apparatus as defined in claim 1, wherein the recording element selection device selects the combination of the recording elements to perform recording of the same main scanning line so as not to use an abnormal one of the recording elements.

5. The image recording apparatus as defined in claim 1, wherein the recording element selection device selects recording elements having mutually similar recording characteristics as the recording elements to perform recording of the same main scanning line.

6. The image recording apparatus as defined in claim 1, wherein when the recording density ratio k upon recording the same main scanning line is 2, then values $(P_1 \times D \times k)$, $(P_2 \times D \times k)$, . . . , $(P_{s \times k} \times D \times k)$, which are obtained by multiplying each of the s×k amounts of movement $P_1, P_2, \ldots, P_{s \times k}$ in the sub-scanning direction by the arrangement density D of the recording elements and then multiplying a resulting product by the recording density ratio k, are either all odd numbers or alternating odd numbers and even numbers.

7. The image recording apparatus as defined in claim 1, wherein the conveyance control device controls the conveyance device so as to satisfy P=n/D, where n is a number of the recording elements and P is a total amount of movement produced by the s×k movements in the sub-scanning direction.

8. The image recording apparatus as defined in claim 1, wherein when an i-th recording element from one end of the recording head is an abnormal recording element, the recording element selection device does not select the i-th recording element from the one end of the recording head and an (n−(i−1))-th recording element from the one end of the recording head.

9. An image recording method, comprising:

a scanning step of moving a recording head in a main scanning direction so as to perform recording of a same main scanning line by means of a plurality of scans in the main scanning direction with respect to a recoding medium, the recording head having at least one row of recording elements arranged at a prescribed arrangement interval in a sub-scanning direction;

a recording step of performing recording by using at least two of the recording elements in the recording of the same main scanning line;

a recording element selection step of selecting a combination of the recording elements to perform recording of the same main scanning line in accordance with a status of each of the recording elements; and a conveyance step of determining a combination of feed amounts in the sub-scanning direction corresponding to the combination of the recording elements selected in the recording element selection step and conveying at least one of the recording head and the recording medium relatively to each other in accordance with the determined combination of feed amounts in the sub-scanning direction, wherein, where s is a number of multiple passes which is a number of recording actions on the same main scanning line, D is an arrangement density of the recording elements expressed as a number of the recording elements per unit length, and k is a ratio of a recording density in the sub-scanning direction with respect to the arrangement density D of the recording elements, in the conveyance step, at least one of the recording head and the recording medium is moved by repeating a sub-scanning sequence constituted of s×k movements in the sub-scanning direction, and a remainder that is obtained by multiplying a total amount of movement to each of the s×k movements in the sub-scanning direction by the arrangement density D of the recording elements and multiplying a resulting product by the recording density ratio k, and then dividing a resulting product by the recording density ratio k, becomes a combination of values from 0 to k−1 that are equal in number to the number of multiple passes s.

10. The image recording method as defined in claim 9, further comprising:

a test pattern forming step of forming a test pattern with the recording elements;

a reading step of reading the test pattern formed in the test pattern forming step; and a storing step of storing the status of the recording elements judged according to reading results of the reading step, wherein in the recording element selection step, the combination of the recording elements that perform recording of the same main scanning line is selected by referring to the status of the recording elements stored in the storing step.

11. The image recording method as defined in claim 10, wherein the test pattern includes patterns of a plurality of types having different combinations of the recording elements that perform recording of the same main scanning line.

12. The image recording method as defined in claim 9, wherein in the recording element selection step, the combination of the recording elements to perform recording of the same main scanning line is selected so as not to use an abnormal one of the recording elements.

13. The image recording method as defined in claim 9, wherein in the recording element selection step, recording elements having mutually similar recording characteristics are selected as the recording elements to perform recording of the same main scanning line.

14. The image recording method as defined in claim 9, wherein when the recording density ratio k upon recording the same main scanning line is 2, then values ($P_1 \times D \times k$), ($P_2 \times D \times k$), ($P_{s \times k} \times D \times k$), which are obtained by multiplying each of the s×k amounts of movement $P_1, P_2, \ldots, P_{s \times k}$ in the sub-scanning direction by the arrangement density D of the recording elements and then multiplying a resulting product by the recording density ratio k, are either all odd numbers or alternating odd numbers and even numbers.

15. The image recording method as defined in claim 9, wherein in the conveyance step, the at least one of the recording head and the recording medium is moved so as to satisfy $P=n/D$, where n is a number of the recording elements and P is a total amount of movement produced by the s×k movements in the sub-scanning direction.

16. The image recording method as defined in claim 9, wherein in the recording element selection step, when an i-th recording element from one end of the recording head is an abnormal recording element, the i-th recording element from the one end of the recording head and an (n−(i−1))-th recording element from the one end of the recording head are not selected.

* * * * *